US009260236B2

(12) United States Patent
Schumacher et al.

(10) Patent No.: US 9,260,236 B2
(45) Date of Patent: Feb. 16, 2016

(54) CARRIER FOR A PORTABLE DISPENSER

(71) Applicant: S.C. Johnson & Son, Inc., Racine, WI (US)

(72) Inventors: Donald J. Schumacher, Racine, WI (US); Mark W. Geis, Oak Creek, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 83 days.

(21) Appl. No.: 13/894,702

(22) Filed: May 15, 2013

(65) Prior Publication Data

US 2014/0339263 A1 Nov. 20, 2014

(51) Int. Cl.

| | |
|---|---|
| ***B67D 7/84*** | (2010.01) |
| ***B65D 83/38*** | (2006.01) |
| ***B65D 83/40*** | (2006.01) |
| ***B65D 51/24*** | (2006.01) |
| ***A45F 5/02*** | (2006.01) |

(52) U.S. Cl.

CPC ..... *B65D 83/388* (2013.01); *A45F 5/021* (2013.01); *B65D 51/242* (2013.01); *B65D 83/40* (2013.01); *A45F 2200/0566* (2013.01)

(58) Field of Classification Search

CPC ..... A45F 5/02
USPC ..... 222/180, 182, 175, 402.1–402.25
See application file for complete search history.

(56) References Cited

U.S. PATENT DOCUMENTS

| | | | | | |
|---|---|---|---|---|---|
| 2,973,881 | A | * | 3/1961 | Ostrowitz | 220/784 |
| 3,414,167 | A | | 12/1968 | Osrow | |
| 3,428,220 | A | | 2/1969 | Osrow | |
| 3,532,249 | A | * | 10/1970 | Gach | 220/284 |
| 3,565,295 | A | * | 2/1971 | Doyle | 222/182 |
| 3,633,789 | A | * | 1/1972 | Markowitz | 220/784 |
| 3,804,286 | A | | 4/1974 | Watson et al. | |
| 3,920,162 | A | | 11/1975 | Kimura | |
| 3,979,163 | A | * | 9/1976 | Beard | 401/139 |
| 4,023,712 | A | * | 5/1977 | Babiak et al. | 222/175 |
| 4,258,857 | A | * | 3/1981 | McGee | 220/212 |
| 5,302,302 | A | * | 4/1994 | Shelley et al. | 224/148.4 |
| 5,337,912 | A | | 8/1994 | Jochem | |
| 5,664,712 | A | * | 9/1997 | Smrt | 224/250 |
| 5,730,118 | A | * | 3/1998 | Hermanson | 128/200.14 |
| 6,644,491 | B2 | * | 11/2003 | Nally et al. | 220/276 |
| 6,769,563 | B2 | | 8/2004 | Tumlin et al. | |
| 8,118,511 | B1 | * | 2/2012 | Stadnyk | 401/262 |
| 2004/0217139 | A1 | * | 11/2004 | Roth et al. | 224/148.7 |
| 2008/0067182 | A1 | | 3/2008 | Underwood et al. | |

(Continued)

FOREIGN PATENT DOCUMENTS

DE 2908111A1 A1 9/1980

OTHER PUBLICATIONS

PCT/US2014/037773 International Search Report and Written Opinion dated Aug. 4, 2014.

(Continued)

*Primary Examiner* — Donnell Long

(57) ABSTRACT

A carrier mounts an aerosol spray can on a backpack, a belt loop or the like. The carrier has a pair of downwardly depending skirts that are radially spaced from each other, and also has an upper connector section. There are two lower catches, one on each skirt, which snap onto the top of the can in opposed directions. There may also be a positive stop along an inner side of the outer skirt.

13 Claims, 4 Drawing Sheets

(56) References Cited

U.S. PATENT DOCUMENTS

2011/0284601 A1* 11/2011 Pullin ..... 224/251
2012/0187150 A1* 7/2012 Glasmann ..... 222/175

OTHER PUBLICATIONS

A 2011 photograph of a Repel portable insect lotion repellent dispenser, admitted prior art.

* cited by examiner

CARRIER FOR A PORTABLE DISPENSER

CROSS-REFERENCE TO RELATED APPLICATIONS

Not applicable

STATEMENT REGARDING FEDERALLY SPONSORED RESEARCH/DEVELOPMENT

Not applicable

BACKGROUND OF THE INVENTION

The present invention relates to carriers for mounting portable dispensers (e.g. aerosol spray cans containing mosquito repellent) on a backpack, clothing belt or the like so that these dispensers can be conveniently transported and accessed outdoors.

Portable dispensers have been used to deliver a variety of chemicals to human skin and other surfaces to be treated. Among these chemicals are pest control materials (e.g. insect repellants such as DEET), perfumes, deodorants, and skin protectors (e.g. sunscreen). Many of these dispensers are typically stored in a home, and then applied in the home shortly before one goes outdoors (with the dispenser then being left in the home between applications). However, during some outdoor activities (e.g. hiking, camping, sailing) it is desirable to apply/reapply certain of these chemicals.

Carrying conventional dispensers outdoors can sometimes be problematic. Simply placing such a dispenser in a backpack makes accessing the dispenser outdoors more complex, and raises the possibility that the dispenser may leak onto other items in the backpack.

Carrying such a dispenser on a separate hanger attached to a belt or a backpack creates design complexity. For example, one prefers (using a relatively lightweight assembly) to provide ready access to the dispenser, protect against inadvertent spraying, and provide a secure attachment between the dispenser and mounting system. Also, it is preferred that the carrying system for a container have a useful life that is not limited to the useful life of the container (to avoid the waste and reduce cost).

U.S. Pat. No. 3,414,167 disclosed an assembly for carrying an aerosol can by attaching it to a cap having an arch shaped loop hanger. However, the connection of the cap to the can was not sufficiently secure for some outdoor applications.

U.S. Pat. Nos. 5,357,912 and 6,769,563 taught caps mountable on an aerosol cans. However, the caps were not designed to be hung from a backpack, belt loop or the like.

US patent application publication 2008/0067182 disclosed caps that anchored on an aerosol can using both an inner and outer skirt. This system also had multiple internal stop walls. However, these caps were not designed as part of a carrier system, and in any event their means of attachment to the can was not sufficiently secure for some outdoor applications.

Hence, improvements are needed with respect to carriers for portable dispensers.

BRIEF SUMMARY OF THE INVENTION

In one aspect the invention provides a carrier for a dispenser. The carrier has a housing with an outer downwardly depending skirt, an inner downwardly depending skirt radially spaced inwardly from the outer downwardly depending skirt, and upper connector section. There is a first lower catch on the inner downwardly depending skirt that extends radially outwardly so as to be suitable to catch onto an upper portion of a dispenser (if a dispenser is positioned adjacent thereto). When the first lower catch is coupled to the dispenser, axially pulling the housing (e.g. the connector section) relative to the dispenser (optionally with some relative tilting) can drive the first lower catch radially inwardly and thereby facilitate decoupling of the carrier from the dispenser.

In a preferred form there is also a second lower catch that is on the outer downwardly depending skirt and extends radially inwardly. This is suitable to catch onto another upper portion of the dispenser if the dispenser is positioned adjacent thereto. When the second lower catch is coupled to the dispenser, axially pulling the connector relative to the dispenser (again optionally with some slight relative tilting) can drive the second lower catch radially outwardly and further facilitate decoupling of the carrier from the dispenser. In this embodiment the carrier housing is twice anchored to the can, by catches that flex in opposed directions.

In other preferred forms the carrier is coupled to an aerosol spray container for delivering an insect control ingredient such as a 30% formulation of DEET, and the connector section is in the form of an arch that can be linked to an item carried by a human (e.g. a belt loop or backpack loop).

In another preferred form there is a stop (or multiple stops) positioned on a radially inward side of the outer downwardly depending skirt to restrict the downward movement of the housing relative to the dispenser.

Various embodiments of the present invention have one or more advantages. For example, the carrier may carry insect sprays, sunscreens and other chemicals that can be applied/reapplied outdoors in a hands free manner. The dispensers can be accessed quite easily, and then remounted (e.g. on a backpack or belt loop) after each application, all without the hiker, jogger or the like needing to stop walking/running during this process.

When a spray can is used up, the consumer can dispose of the can and replace it with another. The carrier can be reused many times, with many such refills. This lowers the overall cost of using the system (as a carrier does not need to be purchased with each refill can).

Moreover, the carrier is inexpensive to produce and may be made of a material that is well suited for long term outdoor use.

The connection between the carrier and the can is a secure connection unlikely to be accidentally released. In a preferred form this is achieved by multiple radially spaced anchoring points, and where the catches flex in opposite directions. Also, where the second catch is in the form of a continuous flange it acts as a form of seal between the can and carrier (thereby minimizing leakage). These advantages are achieved without compromising the ability of the dispensing can to be easily released from the mounting when desired.

The foregoing and other advantages of the present invention will be apparent from the following description of the preferred embodiments. As these embodiments are merely illustrative, they are not intended to represent the full scope of the invention. Thus, reference should therefore be made to the claims herein for interpreting the scope of the invention.

DETAILED DESCRIPTION OF THE PREFERRED EMBODIMENTS

Figure 1:
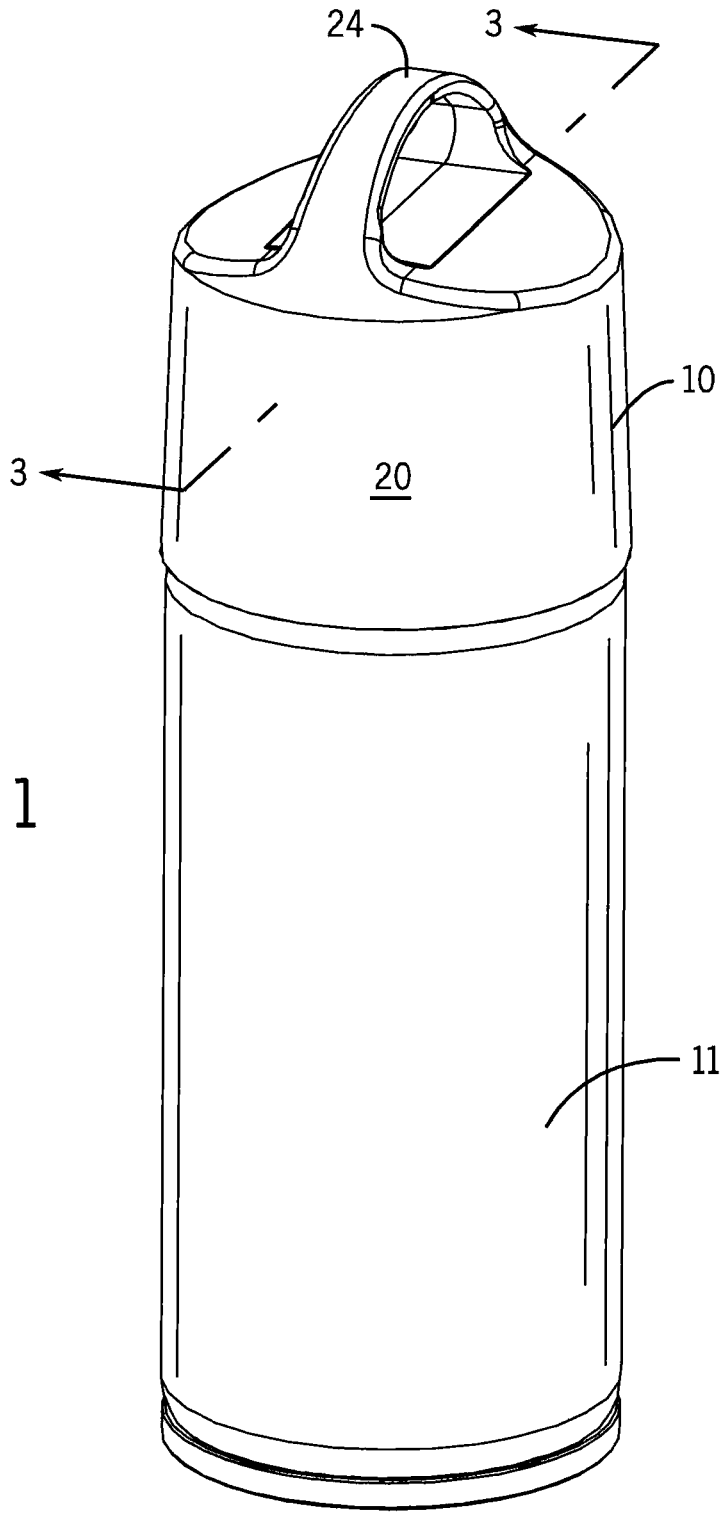
FIG. 1 is a perspective view of a carrier of the present invention shown mounted to and on a spray can.
Figure 3:
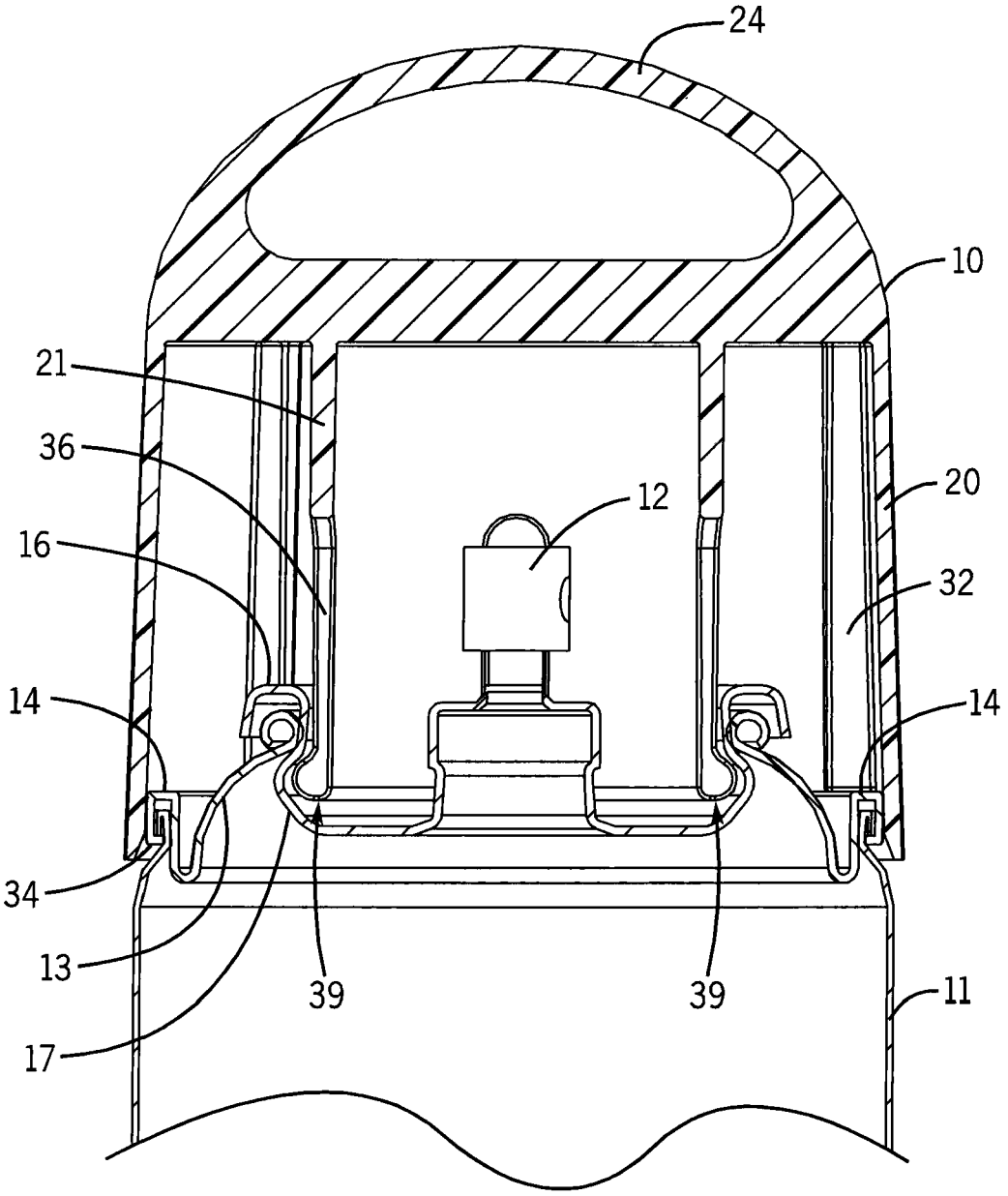
FIG. 3 is a vertical cross sectional view taken along line 3-3 of FIG. 1, of an upper portion thereof.

A preferred carrier 10 is shown in FIG. 1 and FIG. 3 mounted on and coupled to an aerosol can 11. The aerosol can has a spray nozzle 12 and an upper tapered portion on which is mounted a closure 13 having a bent over web 14. There is a valve assembly having a bent over flange 16 that supports the spray nozzle 12. There is also a groove 17 formed below the flange 16.

Carrier 10 is in the form of a housing having an outer downwardly depending skirt 20 and an inner downwardly depending skirt 21. There is also a connector section 24 in the form of an arch, and vertically extending stop ribs 32 formed along an inner wall of the outer downwardly depending skirt 20. The carrier 10 may be formed of a somewhat flexible plastic such as polypropylene or polyethylene.

Figure 4:
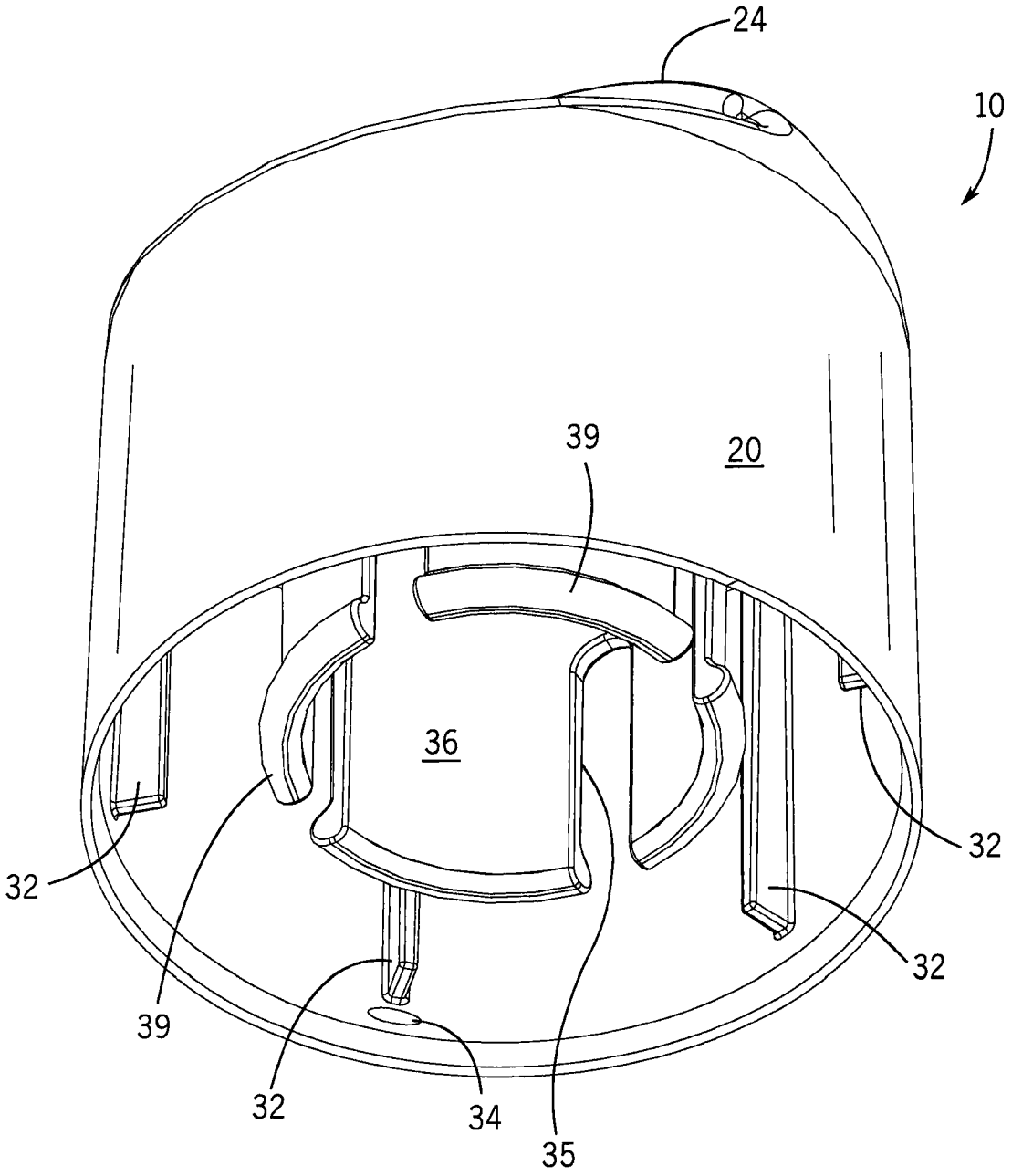
FIG. 4 is a lower perspective view of the carrier of FIG. 1.

As will be evident from FIG. 4, the inner downwardly depending skirt 21 has axial slits 35 which define adjacent flexible legs 36. At the bottom of the legs 36 are formed radially outwardly extending catch feet 39.

Starting with the parts positioned as shown in FIG. 3, axially pulling connector section 24 upward relative to aerosol can 11 drives catch feet 39 slightly inwardly, thereby releasing that coupling.

A lower portion of the outer downwardly depending skirt 20 may optionally have a radially inwardly extending catch 34 in the form of a flange. This catch 34 can snap lock under bent over web 14 (as shown in FIG. 3), and be released by pulling the connector section 24 axially relative to the aerosol can 11 (optionally with a slight relative tilting). After use of the aerosol can 11 as shown in FIG. 2B the carrier can be snapped back on the can so as to be anchored at two upper locations.

Figure 2A:
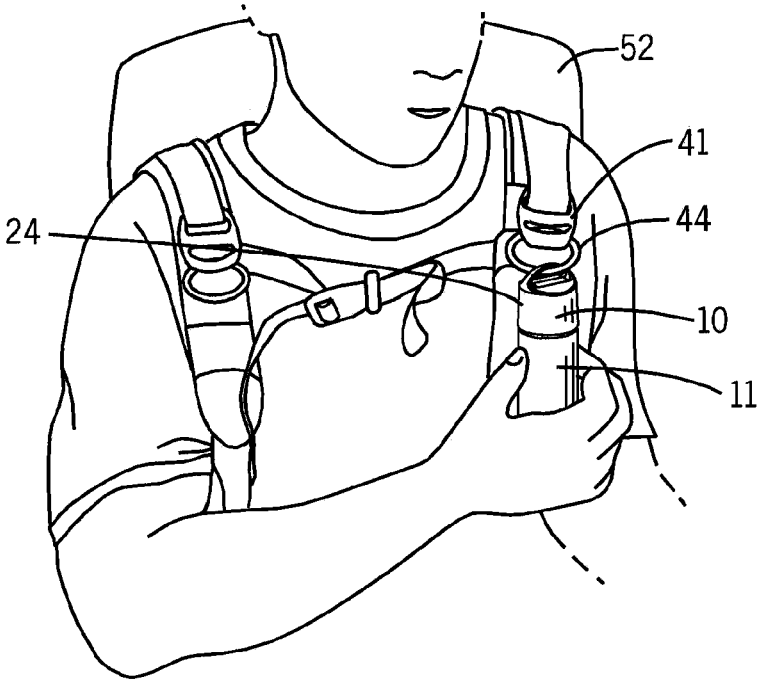
FIG. 2A depicts the FIG. 1 carrier/can assembly hung from a backpack and in the process of having the can disconnected from the carrier.
Figure 2B:
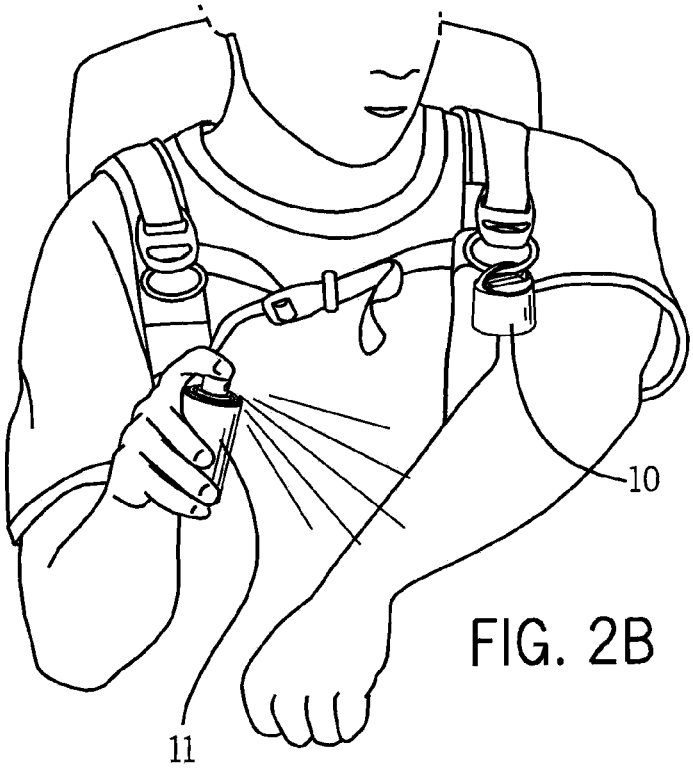
FIG. 2B shows how the can of FIG. 2A can be used to spray repellent on a human arm while the carrier remains attached to a backpack.

As depicted in FIG. 2A, a carabineer type clip 44 can loop through connector section 24, and also a belt loop or backpack loop 41. This will mount the carrier/can assembly on the belt or backpack loop. Thereafter, the can may then be separately accessed for spraying.

Aerosol can 11 preferably stores a mosquito repellent formulation such as a 30% DEET formulation. It can instead store other materials such as an insecticide, or skin treatment materials such as sunscreen, perfume, a deodorant, or a sanitizer. As another example, the can may be filled with an insecticide formulated so as to be suitable to be sprayed around a tent entry flap when the tent is erected.

When/if a hiker wishes to refresh insect protection (e.g. after a few hours of a hike), the hiker may pull the aerosol can 11 down to free the can from the carrier 10. However, there is then still a clip connection causing the carrier to remain on a backpack 52 at a loop 41.

While the above describes preferred embodiments of the present invention, it should be appreciated that other embodiments are also within the scope of the invention. For example, the active container may be a pump sprayer or squeeze tube rather than an aerosol can, and the mounting connector may be another type of connector besides a clip.

Regardless, the invention is not to be limited to just the specific embodiments shown or described, and the following claims should therefore be looked to in order to judge the full scope of the invention.

INDUSTRIAL APPLICABILITY

There are disclosed assemblies for facilitating the carrying of dispensers outdoors, particularly allowing the dispenser to be hung from an item carried by a human and readily accessed when needed.

All documents cited in this patent are, in relevant part, incorporated herein by reference. The citation of any document is not to be construed as an admission that it is prior art with respect to the present invention.

What is claimed is:

1. A carrier for a dispenser, the carrier comprising:

a housing having an outer downwardly depending skirt, and an inner downwardly depending skirt radially spaced inwardly from the outer downwardly depending skirt, and an upper connector section connecting the skirts, the upper connector section including an upper arch extending across the outer downwardly depending skirt;

wherein a first lower catch on the inner downwardly depending skirt extends radially outwardly so as to be suitable to catch onto a first upper portion of the dispenser if a dispenser is positioned adjacent thereto; and wherein, if the first lower catch is coupled to the dispenser, axially pulling the housing relative to the dispenser can drive the first lower catch radially inwardly and thereby facilitate decoupling of the carrier from the dispenser;

the carrier further comprising a second lower catch on the outer downwardly depending skirt extending radially inwardly so as to also be suitable to catch onto a second upper portion of the dispenser if the dispenser is positioned adjacent thereto;

wherein, if the second lower catch is coupled to the dispenser, axially pulling the connector section relative to the dispenser can drive the second lower catch radially outwardly and thereby further facilitate decoupling of the carrier from the dispenser;

the carrier further comprising a stop positioned on a radially inward side of the outer downwardly depending skirt, the stop being parallel with the outer downwardly depending skirt and extending downward from the connector section and terminating above the second lower catch to restrict downward movement of the housing relative to the dispenser by engaging the second upper portion of the dispenser;

wherein a bottom surface of the first lower catch is adjacent a bottom surface of the stop.

2. The carrier of claim 1, wherein the carrier is coupled to the dispenser.

3. The carrier of claim 2, wherein the dispenser is an aerosol spray container.

4. The carrier of claim 3, wherein the aerosol spray container contains an insect control ingredient.

5. The carrier of claim 1, wherein the upper arch is configured to be linked to an item carried by a human.

6. The carrier of claim 5, wherein the item carried by a human is a loop portion of clothing or a backpack.

7. The carrier of claim 1, wherein the stop is vertically extending.

8. The carrier of claim 1, wherein the second lower catch includes a plurality of radially spaced catches positioned on the outer downwardly depending skirt and wherein the stop includes a plurality of radially spaced stops positioned on the outer downwardly depending skirt and wherein each one of the plurality of radially spaced catches align with each one of the plurality of stops.

9. The carrier of claim 8, wherein each of the plurality of stops includes a bottom surface that contacts an upper surface of the second upper portion of the dispenser when the carrier is positioned on the dispenser.

10. The carrier of claim 8, wherein a length of the inner downwardly depending skirt is substantially the same as a length of the plurality of stops.

11. The carrier of claim 1, wherein the upper connector section includes a bottom side and the bottom surface of the first lower catch and the bottom surface of the stop are about the same distance below the bottom side of the upper connector section.

12. The carrier of claim 11, wherein the bottom surface of the first lower catch is positioned below a top surface of the first upper portion of the dispenser when the carrier is positioned on the dispenser.

13. The carrier of claim 1, wherein a length of the inner downwardly depending skirt is substantially the same as a length of the stop.

* * * * *